US012474057B2

(12) United States Patent
Walker et al.

(10) Patent No.: US 12,474,057 B2
(45) Date of Patent: Nov. 18, 2025

(54) ELECTRIC BURNER

(71) Applicant: Flynn Burner Corporation, Mooresville, NC (US)

(72) Inventors: Simon Walker, Mooresville, NC (US); Jim M Sweeney, Mooresville, NC (US)

(73) Assignee: Flynn Burner Corporation, Mooresville, NC (US)

( * ) Notice: Subject to any disclaimer, the term of this patent is extended or adjusted under 35 U.S.C. 154(b) by 352 days.

(21) Appl. No.: 18/205,890

(22) Filed: Jun. 5, 2023

(65) Prior Publication Data

US 2023/0392792 A1 Dec. 7, 2023

Related U.S. Application Data

(60) Provisional application No. 63/348,657, filed on Jun. 3, 2022.

(51) Int. Cl.
*F24C 1/02* (2021.01)
*F23D 14/10* (2006.01)

(52) U.S. Cl.
CPC ..... *F24C 1/02* (2013.01); *F23D 14/105* (2013.01)

(58) Field of Classification Search
CPC ..... F24C 1/04; F24C 1/02; F24D 14/105
USPC ..... 392/307–310; 126/39 BA
See application file for complete search history.

(56) References Cited

U.S. PATENT DOCUMENTS 1,946,547 A * 2/1934 Russell ..... H05B 3/50 219/520
2,517,255 A * 8/1950 Strebe ..... F24H 3/002 126/90 R
5,665,302 A * 9/1997 Benni ..... C21D 9/70 219/400
2003/0057615 A1* 3/2003 Eckert ..... B22D 37/00 266/239
2021/0404655 A1* 12/2021 Bijkerk ..... F23D 14/02

* cited by examiner

*Primary Examiner* — Vivek K Shirsat
(74) *Attorney, Agent, or Firm* — Amundsen Davis, LLC

(57) ABSTRACT

A hybrid tubular pipe burner has a lateral flame emitted from a slot in the tubular pipe burner, the tubular pipe burner being supplemented with the placement of spaced electric heaters disposed outside the pipe burner. The electric heaters run along the length of the pipe burner but are disposed such that they stand off and away from the surface of the pipe burner. The pipe burner is configured to allow for initial gas firing and preheating. Upon reaching the required temperature, the gas firing will cease and the electric heaters will take over. The gas is used for preheating only. The continued flow of air through the pipe prevents deformation of the pipe in the pipe burner.

7 Claims, 5 Drawing Sheets

ELECTRIC BURNER

This application claims the benefit of U.S. Provisional Application No. 63/348,657, filed Jun. 3, 2022.

FIELD OF THE INVENTION

The present invention relates generally to industrial ovens of the type that are used to cook commercial food products, including direct gas fired baking ovens and the like. The present invention also relates generally to a tubular pipe burner of the type used in such an oven, the pipe burner providing a lateral flame within a flame space along the length of the pipe burner from a ribbon slot formed in the tubular pipe burner. This lateral flame can be configured for adjustment along the length of the pipe burner to equalize baked product color and moisture. More specifically, the tubular pipe burner in accordance with the present invention provides a hybrid gas and electric pipe burner that is capable of operating with a significantly reduced carbon footprint by allowing for initial gas firing of the pipe burner followed by continued heating along the length of the pipe burner using electric means only.

BACKGROUND OF THE INVENTION

Direct gas fired ovens have long been used for baking food products and for other heat applications. Such ovens typically employ one or more burners that are fueled by gas, such as natural gas, propane and butane. This includes tubular pipe burners of a type that have a lateral flame emitted from a slot, or "ribbon", formed longitudinally within the tubular pipe burner. In the present age of awareness of "carbon footprints", however, it is a goal of this inventor to eliminate or minimize the use of fossil fuels and the like and replace them or supplement them with electric means. Therefore, and in the experience of this inventor, there is need for an improved pipe burner that uses a hybrid gas and electric arrangement for providing the same heating capabilities of a typical gas pipe burner while also providing a means for initial gas firing followed by continued heating by electric means only.

SUMMARY OF THE INVENTION

The concept of the present invention is to provide a tubular pipe burner of a type that has a lateral flame emitted from a slot in the tubular pipe burner, the tubular pipe burner of the present invention being supplemented with the placement of spaced electric heaters disposed outside the pipe burner. The electric heaters run along the length of the pipe burner but are disposed such that they stand off and away from the surface of the pipe burner. The pipe burner is configured to allow for initial gas firing and preheating. Upon reaching the required temperature, the gas firing will cease and the electric heaters will take over. The gas is used for preheating only. The continued flow of air through the pipe prevents deformation of the pipe in the pipe burner.

The foregoing and other features of the pipe burner of the present invention will be apparent from the detailed description that follows.

DETAILED DESCRIPTION OF THE INVENTION

Figure 1:
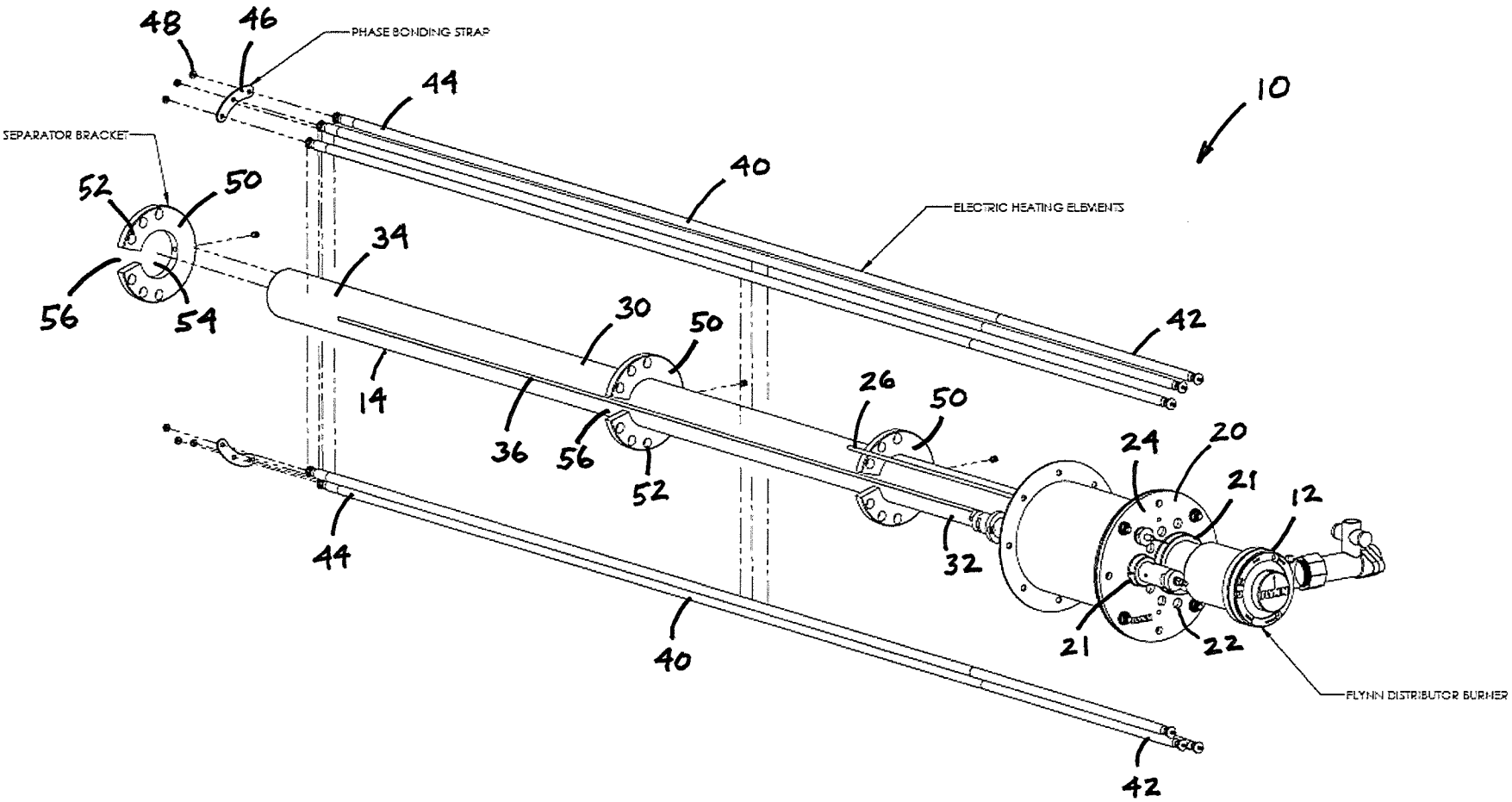
FIG. 1 is an exploded perspective view of a representative pipe burner configured in accordance with the present invention.

Referring now to the drawings in detail, wherein like-numbered elements refer to like elements throughout, FIG. 1 illustrates a pipe burner, generally identified 10, constructed in accordance with the present invention. The burner 10 comprises a proximal portion 12 that is disposed to the exterior of an oven (not show) and further comprises a distributor burner 20 at that proximal end of the pipe burner 10.

The distributor burner 20 further comprises insulating plugs 21 which prevent heat spillage from inside the oven to the outside of the oven. Extending inwardly from the distributor burner 20 is a distal portion 14 of the burner 10, which also includes a center support 30. These structures are disposed within the interior of the oven (again, not shown). The center support 30 comprises a proximal end 32 and a distal end 34. An overall flame space is created by a ribbon slot 36 defined within the center support 30 and running from the proximal end 32 and the distal end 34.

Figure 2:
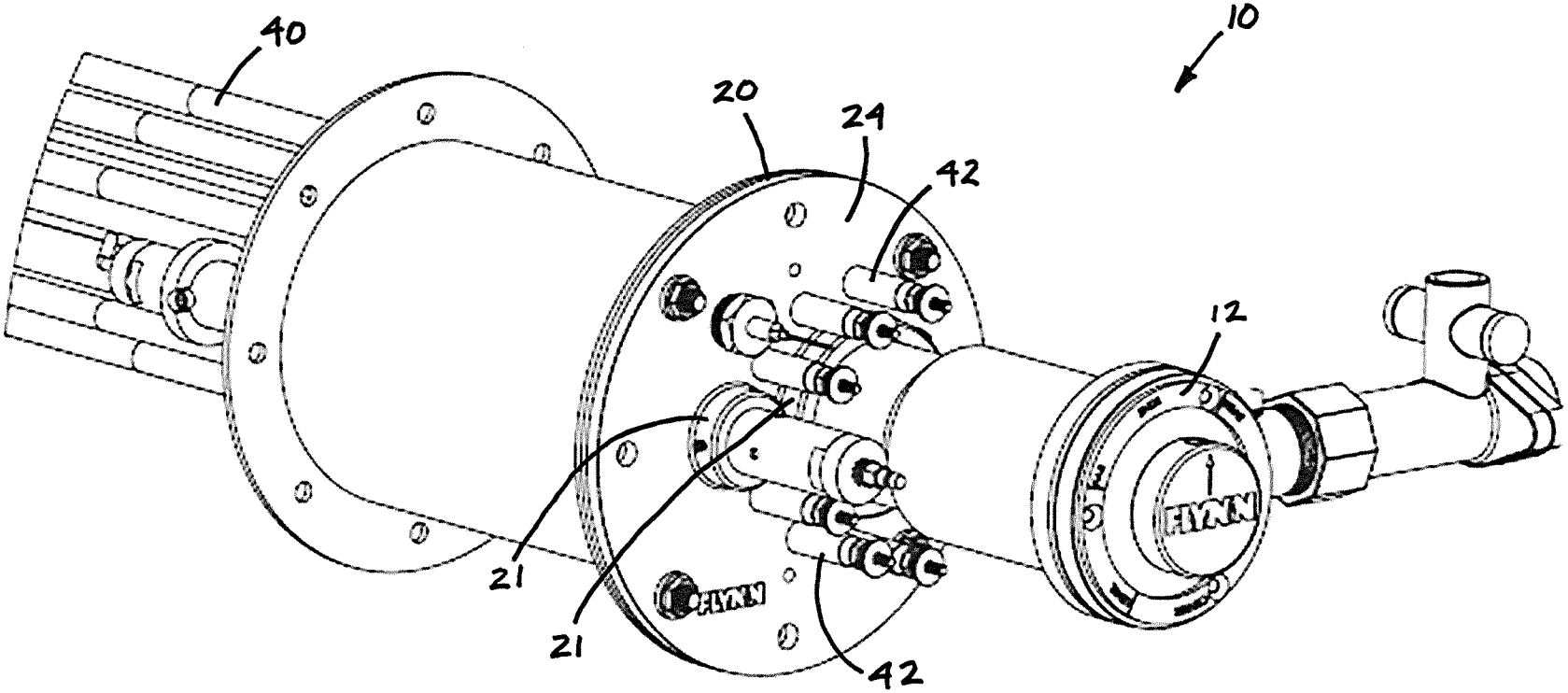
FIG. 2 is an enlarged perspective view of the proximal end of the pipe burner shown in FIG. 1 but showing some of the elements at that proximal end as assembled and attached to one another.
Figure 3:
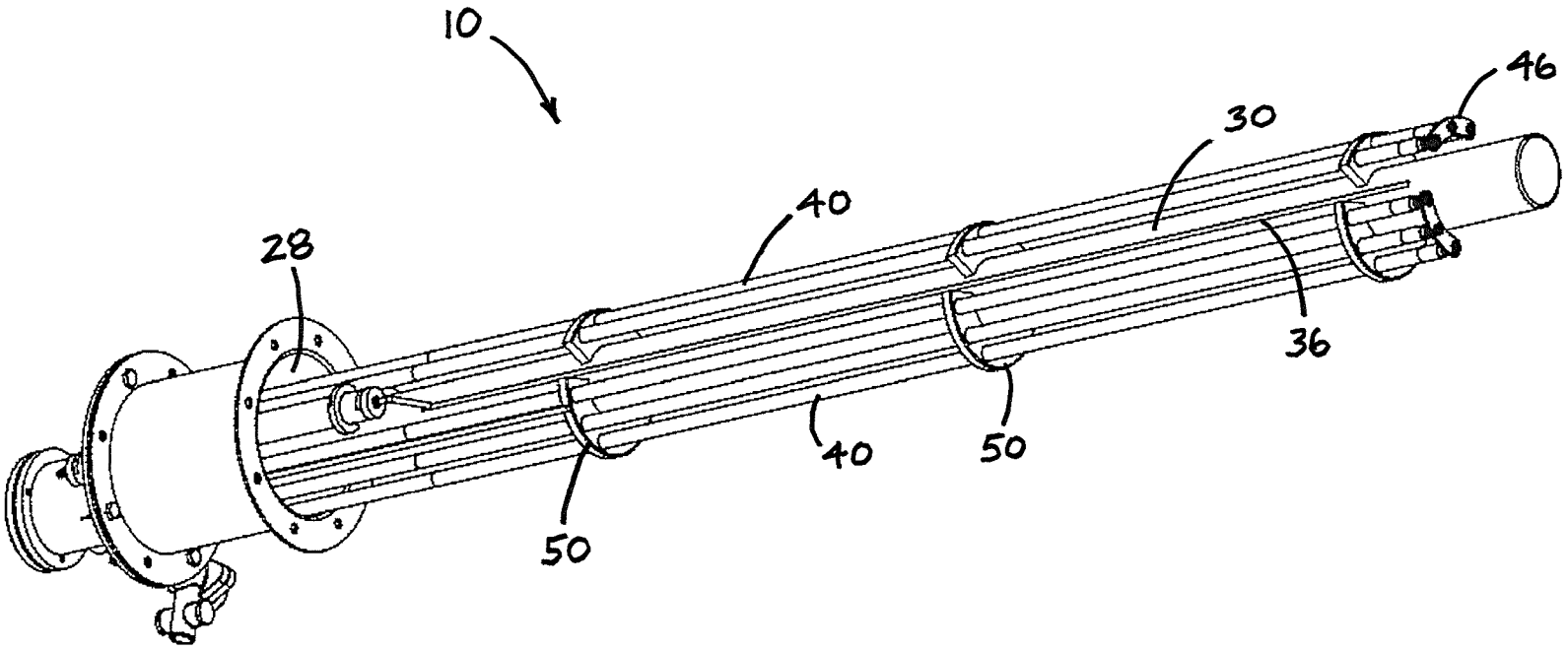
FIG. 3 is another perspective view of the pipe burner shown from its distal end.
Figure 4:
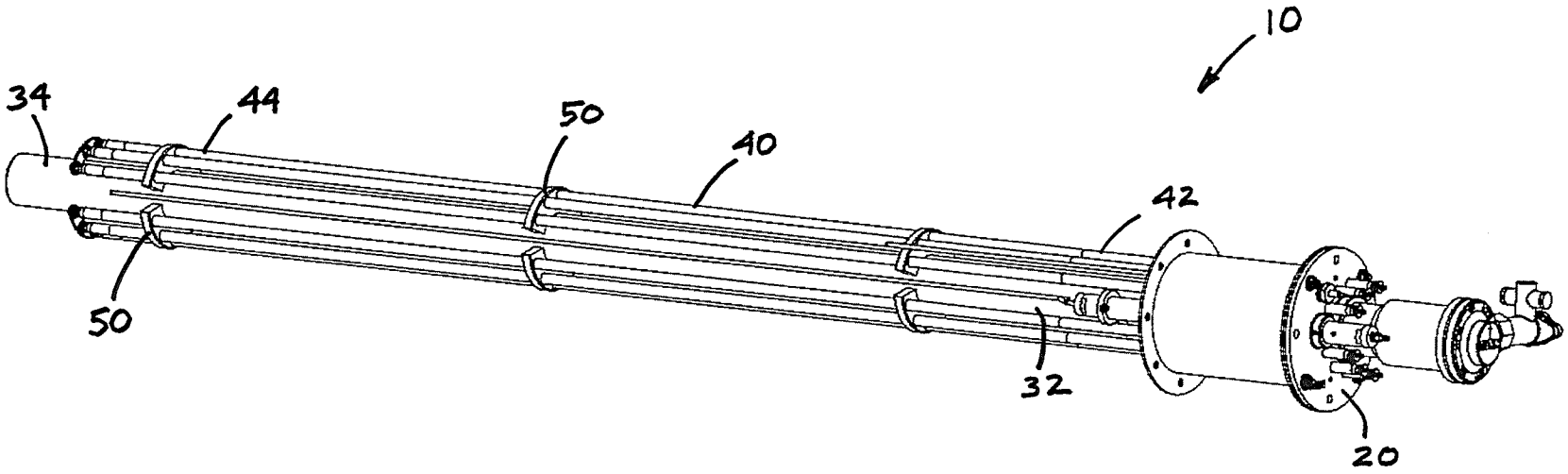
FIG. 4 is a slightly rotated elevational view of the pipe burner shown in FIG. 3.
Figure 5:
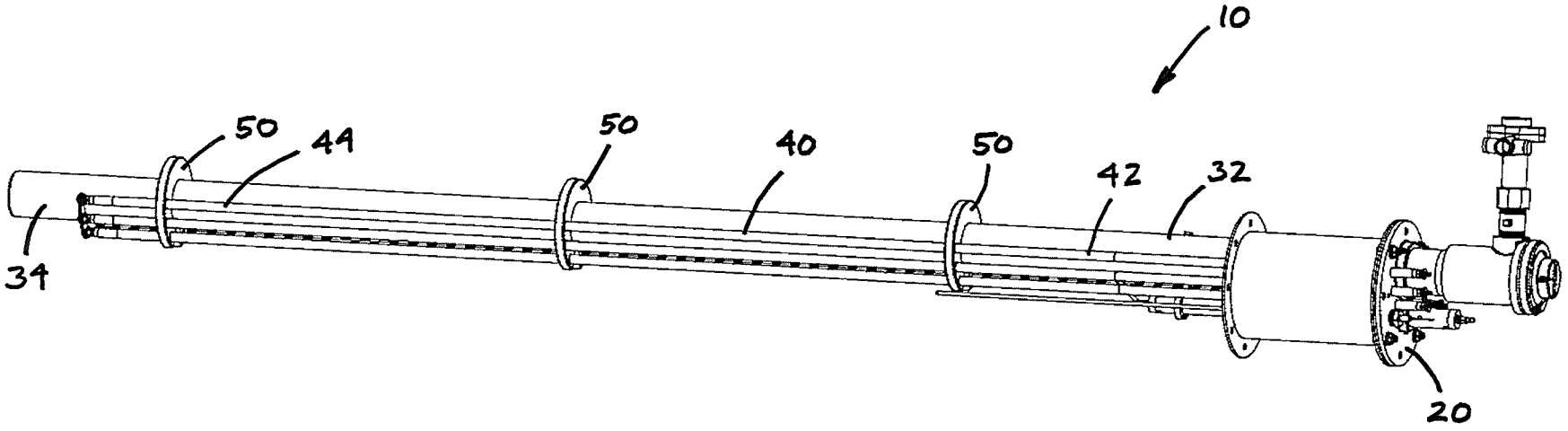
FIG. 5 is another slightly rotated elevational view of the pipe burner shown in FIG. 3.

The center support 30 can be a sealed pipe for electric only. In the preferred embodiment, however, the ribbon slot 36 is used for a regular flame for boosting preheat or it can be fitted to blow air through to prevent the center support 30 from any deformation. The center support 30 can support three heaters 40 (or "electric heater elements") for normal baking but can support six heaters 40 when more heat is required. Each heater 40 comprises a proximal end 42 and a distal end 44. The distal end 44 of three heaters 40 are secured together by means of a phase bonding strap 46 and three fasteners 48. As illustrated in FIGS. 2 and 3, the proximal ends 42 of the heaters 40 pass through a bore 28 and are fastened to a flange 24 via holes 22 defined in the flange 24 of the distributor burner 20. In the preferred embodiment, the center support 30 is painted with high emissivity ceramic paint to increase efficiency of heat transfer.

The pipe burner 10 further comprises a plurality of separator brackets 50. Each separator bracket 50 comprises a "C-shaped" structure having an opening 54 such that the bracket 50 can capture the center support 30. A plurality of receiving holes 52 is defined within the bracket 50 such that the holes 52 of several brackets 50 are colinear so as to hold the electric heating elements 40 in a parallel position relative to the center support 30 and the other heating elements 40. The heating elements 40 are also colinear relative to the holes 22 that are defined in the flange 24 of the distributor burner 20. Each bracket 50 further comprises an opening 56. The bracket openings 56 are aligned such that each opening 56 does not overlay the ribbon slot 36 of the center support 30 so as to avoid direct contact with the flame coming from the ribbon slot 36 during startup or warmup. Optimally, the brackets 50 are disposes every twenty-four inches to prevent any deflection of the heaters 40.

Lastly, a high temperature safety thermocouple 26 is provided to prevent the heater elements 40 from overheating.

We claim:

1. A pipe burner for use with an oven, the oven comprising an interior and an exterior, the pipe burner comprising:

a proximal portion disposed to the exterior of the oven;

a distributor burner at that proximal end of the pipe burner;

an insulating plug which prevents heat spillage from inside the oven to the outside of the oven;

a distal portion extending inwardly from the distributor burner;

a tubular center support;

the distal portion and the tubular center support is disposed within the interior of the oven;

wherein the tubular center support comprises a proximal end and a distal end;

wherein a flame space is created by a longitudinal ribbon slot defined within the tubular center support, the flame space running from the proximal end to the distal end of the tubular center support;

wherein the ribbon slot is used for a regular flame for boosting preheat within the oven;

a plurality of electric heater elements disposed about the tubular center support;

wherein each electric heater element is a linear structure comprising a proximal end and a distal end;

wherein the distal ends of the plurality of heaters are secured together by a phase bonding strap and fasteners; and wherein initial gas firing of the pipe burner is followed by continued heating along the length of the pipe burner using only the plurality of electric heater elements and cessation of gas burning when a required temperature is reached.

2. The pipe burner of claim 1 wherein the proximal ends of the plurality of heaters pass through a bore and are fastened to a flange via holes defined in the flange of the distributor burner.

3. The pipe burner of claim 2 further comprising a plurality of separator brackets, each separator bracket comprising:

a flat round structure having an opening such that the bracket can capture the center support; and a plurality of receiving holes defined within the bracket such that the holes of several brackets are colinear to hold the electric heater elements in a parallel position relative to the center support and the other electric heater elements.

4. The pipe burner of claim 3 wherein the electric heater elements are colinear relative to the holes that are defined in the flange of the distributor burner.

5. The pipe burner of claim 4 wherein the bracket openings are aligned such that each opening does not overlay the ribbon slot of the center support to avoid direct contact with the flame coming from the ribbon slot during startup or warmup.

6. The pipe burner of claim 1 wherein the center support is painted with ceramic paint to increase efficiency of heat transfer.

7. The pipe burner of claim 1 further comprising a thermocouple to prevent the electric heater elements from overheating.

* * * * *